US010577854B1

(12) United States Patent
Salmeron

(10) Patent No.: US 10,577,854 B1
(45) Date of Patent: Mar. 3, 2020

(54) REVERSIBLE DOOR FRAME THRESHOLD, AND DOOR SYSTEM INCLUDING SAME

(71) Applicant: Portella Industries, LLC, Austin, TX (US)

(72) Inventor: Misrraim Cardenas Salmeron, Cedar Park, TX (US)

(73) Assignee: Portella Industries, LLC, Austin, TX (US)

( * ) Notice: Subject to any disclaimer, the term of this patent is extended or adjusted under 35 U.S.C. 154(b) by 0 days.

(21) Appl. No.: 16/226,046

(22) Filed: Dec. 19, 2018

(51) Int. Cl.
*E06B 1/70* (2006.01)
*E06B 1/52* (2006.01)
*E06B 7/23* (2006.01)

(52) U.S. Cl.
CPC ..... *E06B 1/70* (2013.01); *E06B 1/526* (2013.01); *E06B 7/2316* (2013.01)

(58) Field of Classification Search
CPC ..... E06B 1/70; E06B 7/2316
See application file for complete search history.

(56) References Cited

U.S. PATENT DOCUMENTS 2,089,380 A * 8/1937 Kammerer ..... E06B 1/70 49/468
2,273,877 A * 2/1942 Kammerer ..... E06B 1/70 16/90
2,856,651 A * 10/1958 Hobbs ..... E06B 1/70 24/132 R
3,402,512 A * 9/1968 Peterson ..... E06B 1/70 49/468
4,003,162 A * 1/1977 Britt ..... E06B 1/70 49/468
4,387,535 A * 6/1983 Corbo ..... E06B 1/70 49/468
5,283,977 A * 2/1994 Smith ..... E06B 7/2316 49/380
5,673,517 A * 10/1997 Stanclift ..... E06B 1/70 49/468
6,289,635 B1 * 9/2001 Procton ..... E06B 1/70 49/467
2018/0298677 A1 * 10/2018 Alkhoury ..... E06B 7/14

* cited by examiner

*Primary Examiner* — Marcus Menezes
(74) *Attorney, Agent, or Firm* — Hunt Pennington Kumar & Dula, pllc

(57) ABSTRACT

A door system may include a threshold assembly having a base including a base drain channel having a major drain surface inclined from a second edge to a first edge thereof, a base drain hole in a second base sidewall to convey water from the base drain channel out to an exterior side, a crown supported by the base may include a crown gutter and gutter drain hole to convey water into the base drain channel, the crown selectively installable on the base in a first position for in-swing movement of a door element or a second position for out-swing movement, the crown position selectable independent of the base to convey water from the crown gutter and base drain channel to the exterior side.

9 Claims, 11 Drawing Sheets

2"
3/16"
3/8"
100
Inswing

3/16"
5/8"
100
3/16"
3/16"
3/16"
3 3/16"
399"
128'
2 9/16"
128
399'
3/16"
Final Floor
173
174
162
1 11/16"
162'
Std. Base
3/4"

Rain
EXT.
INT.
Inswing
Final Floor
Std. Base
100

EXT.
INT.
Outswing
Final Floor
Std. Base
200

Final Floor
Std. Base
100

Water Leakage Path
(Saddle Drain Holes)
Drainage (By Customer)
Final Floor
Std. Base
200

REVERSIBLE DOOR FRAME THRESHOLD, AND DOOR SYSTEM INCLUDING SAME

CROSS REFERENCE TO RELATED APPLICATIONS

This application is not related to any other applications on the date of filing.

FIELD OF THE INVENTION

The disclosure relates generally to door systems. The disclosure relates more particularly to door thresholds for entry door systems located in the exterior wall of a building.

BACKGROUND OF THE INVENTION

Door systems may include a fixed door frame mounted to the wall of a building, and a door body, slab or door element ("door element") supported on a set of hinges for swinging movement relative to the door frame. The door frame may be formed primarily of metal, wood or other suitable structural materials. The door frame may include a pair of door jambs extending vertically from the building floor to a head at top of the door frame. The door jambs may include a hinge jamb where the set of hinges is located, and a strike jamb opposite the hinge jamb. The strike jamb may include door latch hardware for engagement with mating door latch hardware fixed in the door element, opposite the set of hinges. The head is located at the top of the door frame and extends between the door jambs. The door frame, door element, or both may include weather-stripping to reduce or prevent heat transfer through the door system, and wind and precipitation entering the building through spaces or gaps between the door frame and door element. In some configurations, the door jambs and head of the door frame may comprise elongated, hollow profiles formed of metal, such as by extrusion. In some configurations, the door element may comprise a metal frame assembly and an insulating glass unit or pane mounted in the metal frame assembly.

The door frame may include a door threshold assembly ("door threshold assembly") extending between the door jambs at the building floor. Door threshold assemblies may be of various configurations, and may have different components and cross-sectional profiles. In one configuration of an exterior door, a door threshold assembly is configured to extend the width of the door jambs between the building interior and exterior. Door threshold assemblies for exterior doors may be configured to prevent or reduce ingress of precipitation, such as rain, in the bottom edge clearance gap between the door threshold assembly and bottom edge of the door element when the door is closed. Door threshold assemblies for exterior doors may be configured to shed precipitation to outside of the building.

Door systems may include a door which swings inward (i.e., in-swing door) or which swings outward (i.e., out-swing door). Door threshold assemblies for use with an in-swing door may differ from door threshold assemblies for use with an out-swing door, even where the door frame and door element are otherwise identical. Building construction contractors, in order to avoid shortage and delays, thus must determine the door element swing direction of each door and order different door threshold assemblies for the in-swing and out-swing directions, or maintain excess stock of door threshold assemblies for both swing directions. If door swing direction is not fixed in the building construction plans, the contractor either must delay ordering door thresholds until a swing direction is selected, or order excess stock of door threshold assemblies in two configurations, one compatible with an in-swing door and the other compatible with an out-swing door.

For reasons stated above and for other reasons which will become apparent to those skilled in the art upon reading and understanding the present specification, there is a need in the art for improved door threshold assemblies and door systems including same.

BRIEF DESCRIPTION OF THE INVENTION

The above-mentioned shortcomings, disadvantages and problems are addressed herein, as will be understood by those skilled in the art upon reading and studying the following specification. This Brief Description is a summary provided to introduce a selection of concepts in a simplified form that are further described below in more detail in the Detailed Description. This summary is not intended to identify key or essential features of the claimed subject matter.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

In one aspect, one door threshold assembly may be ordered for installation in a door system, without prior knowledge of door in-swing direction or out-swing direction. In an aspect, a door threshold assembly as herein disclosed may be configurable at time of installation in a door system that may be configured either for in-swing or out-swing operation. A door threshold assembly may be ordered for installation in a door system without prior knowledge of in-swing or out-swing configuration, which is configured to shed precipitation to the outside or exterior of the building. Such a door threshold assembly may be configured further to collect precipitation, which has not been shed, for example, precipitation falling on the door threshold assembly when the door is open, and drain the collected precipitation to the outside or exterior of the building. A door threshold assembly as herein disclosed may simplify manufacturing, and may reduce or eliminate need to manufacture multiple, different door threshold assemblies for door systems in the in-swing and out-swing configurations. A door threshold assembly may provide footing support over gaps with adjacent floors, and to compensate for height differentials between the threshold assembly and adjacent floors of different heights.

Apparatus, systems and methods of varying scope are described herein. These aspects are indicative of various non-limiting ways in which the disclosed subject matter may be utilized, all of which are intended to be within the scope of the disclosed subject matter. In addition to the aspects and advantages described in this summary, further aspects, features, and advantages will become apparent by reference to the associated drawings, detailed description, and claims.

BRIEF DESCRIPTION OF THE DRAWINGS

The disclosed subject matter itself, as well as further objectives, and advantages thereof, will best be illustrated by reference to the following detailed description of embodiments of the device read in conjunction with the accompanying drawings, wherein.

DETAILED DESCRIPTION OF THE INVENTION

Figure 1:
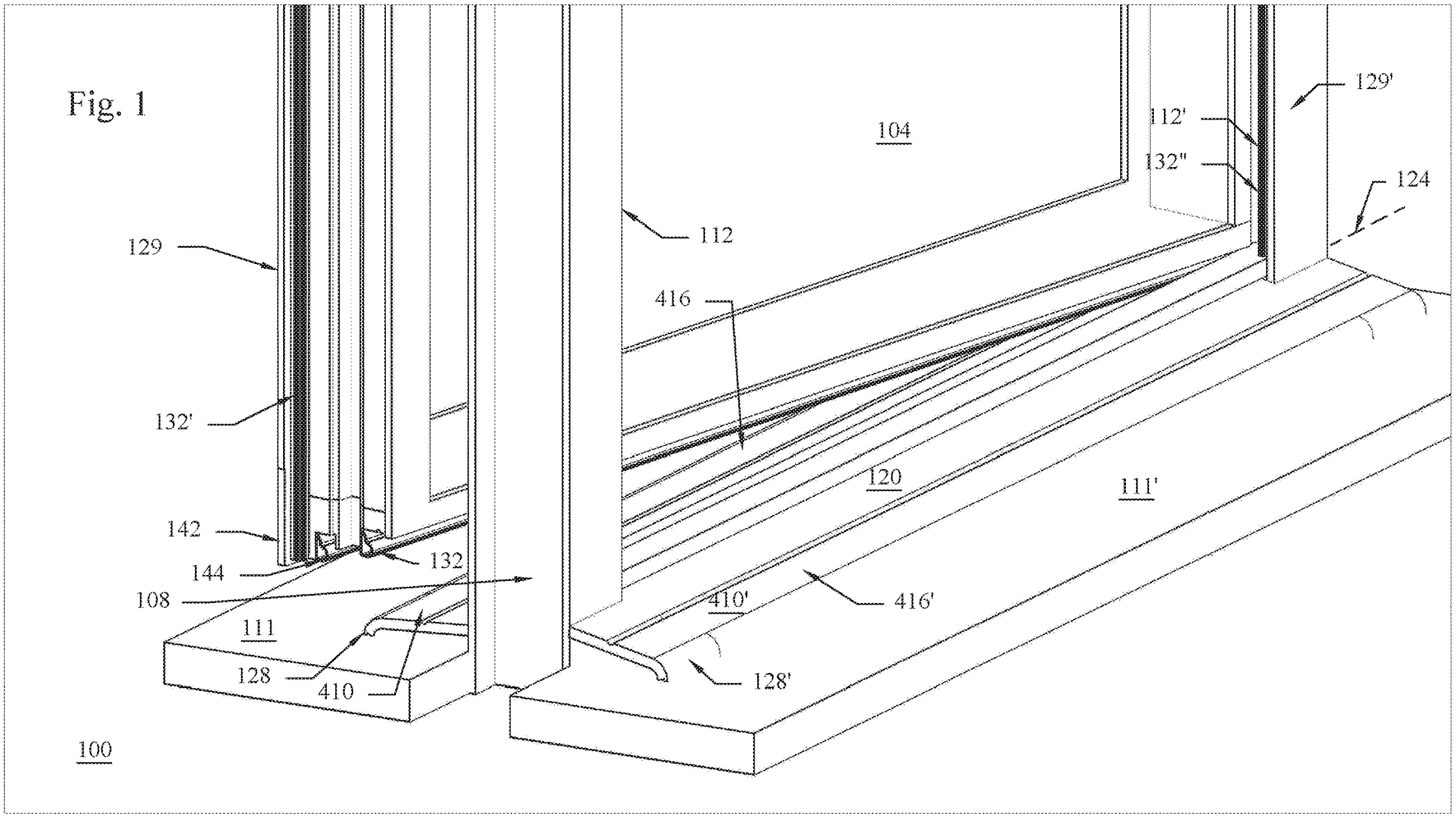
FIG. 1 is a simplified partial perspective view of a door system 100 having a door element in an in-swing configuration and threshold crown in a first position, in an embodiment.

In the following detailed description, reference is made to the accompanying drawings which form a part hereof, and in which is shown by way of illustration specific embodiments which may be practiced. These embodiments are described in sufficient detail to enable those skilled in the art to practice the embodiments and disclosure. It is to be understood that other embodiments may be utilized, and that logical, mechanical, electrical, and other changes may be made without departing from the scope of the embodiments and disclosure. In view of the foregoing, the following detailed description is not to be taken as limiting the scope of the embodiments or disclosure.

The terminology used herein is for the purpose of describing particular embodiments only and is not intended to be limiting. As used herein, the singular forms "a", "an", and "the" are intended to include the plural forms as well, unless the context clearly indicates otherwise. It will be further understood that the terms "comprises" and/or "comprising" or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

It will be appreciated that for simplicity and clarity of illustration, where considered appropriate, reference numerals may be repeated among the figures to indicate corresponding or analogous elements. In addition, numerous specific details are set forth in order to provide a thorough understanding of the implementations described herein. However, it will be understood by those of ordinary skill in the art that the implementations described herein may be practiced without these specific details. In other instances, well-known methods, procedures and components have not been described in detail so as not to obscure the implementations described herein. Also, the description is not to be considered as limiting the scope of the implementations described herein.

The detailed description set forth herein in connection with the appended drawings is intended as a description of exemplary embodiments in which the presently disclosed apparatus and system can be practiced. The term "exemplary" used throughout this description means "serving as an example, instance, or illustration," and should not necessarily be construed as preferred or advantageous over other embodiments.

FIG. 1 is a simplified partial perspective view of a door system 100 in an in-swing configuration, in an embodiment. Door system 100 may include door element 104 supported on door frame 108 by a set of hinges (not shown) located on the hinge jamb of a set of elongated vertical door jambs 112, 112'. Door element 104 is configured and supported for in-swing motion, wherein the in-swing door element opens by swinging inward from the closed position stopped against the strike jamb, to the open position in the interior of the building. In the in-swing configuration shown in FIG. 1, the strike jamb thus prevents door element 104 from swinging outward from the closed position to the outside of the building. Door frame 108 includes a door threshold assembly 120 extending between the set of vertical door jambs 112, 112'.

Door threshold assembly 120 has a major longitudinal axis 124 running between the set of door jambs 112, 112'. Door threshold assembly 120 includes elongated first and second sides 128, 128' defined by respective opposite free edges thereof. First and second sides 128, 128' are disposed in spaced opposition and extend parallel to the longitudinal axis 124 in spaced relationship thereto. Door threshold assembly 120 extends in the lateral direction, perpendicular to the longitudinal axis 124, from first side 128 to second side 128'. First side 128 is defined by a first free edge located inside the building on an interior side 129 of the door system. Second side 128' is defined by a second free edge located outside the building on an exterior side 129' of the door system. As shown in FIG. 1, door frame 108 and door element 104 include weather-stripping 132, 132', 132". When the door is closed, the sides and top of the door element 104 seal against the weather-stripping 132', 132" provided on the door jambs 112, 112' and head (not shown), and the weather stripping 132 along bottom of the door element 104 seals against door threshold assembly 120.

Figure 2:
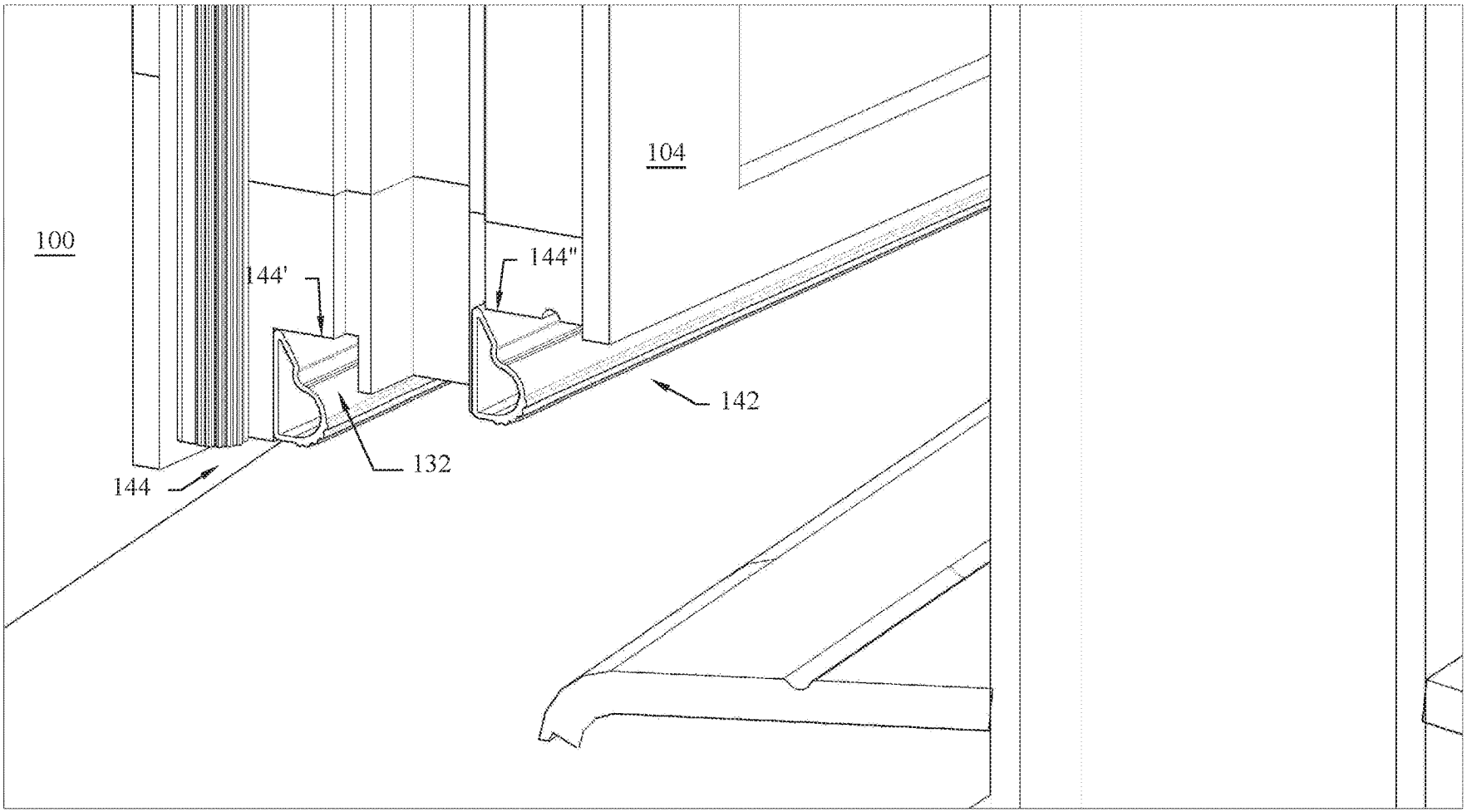
FIG. 2 is a simplified partial perspective view of a portion of door system 100, shown generally in FIG. 1.

FIG. 2 is a simplified partial perspective view of a portion of door system 100, shown generally in FIG. 1. Bottom 140 of door element 104 may include door bottom steps 144. Door bottom steps 144 may include a first step 144' having a first height and a second step 144". Each of the door bottom steps 144 may include weather stripping 132.

Figure 3:
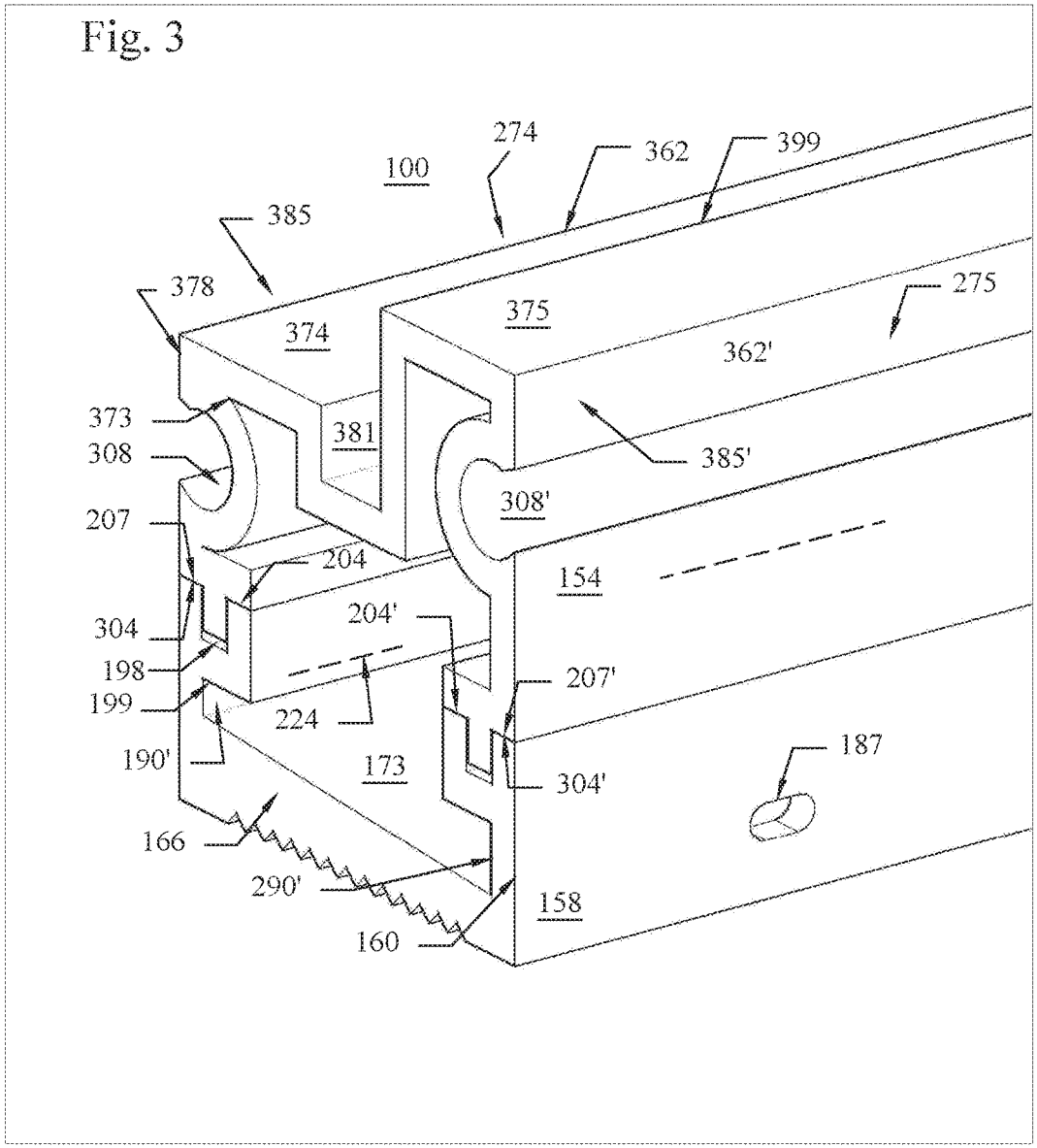
FIG. 3 is a simplified partial perspective isolation view of the threshold of door system 100, shown generally in FIG. 1, from an end perspective.

FIG. 3 is a simplified partial perspective isolation view of the threshold 120 of door system 100, shown generally in FIG. 1, from an end perspective. Threshold 120 may include a crown 154 supported by base 158. Base 158 and crown 154 may be formed of rigid, durable material such as aluminum, brass, other metals, or polymeric material. In the embodiment illustrated in FIG. 3, base 158 and crown 154 are formed of extruded brass. Base 158 and crown 154 each have a longitudinal length sufficient to extend between the door jambs 112, 112'. Base 158 may have a base width perpendicular to the longitudinal axis 124, extending and defined between a pair of spaced, opposed base sidewalls 160 or legs extending parallel to the longitudinal axis 124. The base sidewalls 160 include first base sidewall 162 and second base sidewall 162'. Crown 154 may have a crown width perpendicular to the longitudinal axis 124, extending and defined between a pair of spaced, opposed crown sidewalls 360 extending parallel to the longitudinal axis 124. The pair of crown sidewalls 162 include first crown sidewall 362 and second crown sidewall 362'.

Base 158 includes a base bottom wall 166 intersecting the first base sidewall 162 and second base sidewall 162' and extending therebetween in a lateral direction perpendicular to longitudinal axis 124. Base bottom wall 166 includes a base bottom surface 170 facing downward and extending perpendicular to longitudinal axis 124 for resting upon a floor of the building. Base bottom surface 170 may include a set of serrations or teeth 172 for engagement with the floor. Base bottom wall 166 includes a base major drain surface 174 disposed in opposition and spaced above base bottom surface 170. Base major drain surface 174 intersects the first base sidewall 162 and second base sidewall 162' at first and second bottom inside corners 178, 178'. The first and second bottom inside corners 178, 178' are spaced above and inside respective first and second bottom outside corners 182, 182'. First bottom inside corner 178 is located at a first corner height which is above second bottom inside corner 178' located at second corner height. Base 158 may include base drain channel 173. Base drain channel 173 may include base major drain surface 174, which may be inclined from the second bottom inside corner 178' to first bottom inside corner 178 to direct liquid, such as collected rain or precipitation drained from a gutter located in the crown 154 above, across the base major drain surface 174 to the second bottom inside corner 178' and second base sidewall 162'. Second base sidewall 162' may include a spaced set of apertures or base drain holes 187 extending therethrough above second bottom inside corner 178' to deliver or drain collected water outward from the inclined base major drain surface 174 of base drain channel 173 out through second base sidewall 162' and to the outside or exterior of the building.

As shown in FIG. 3, the first base sidewall 162 and second base sidewall 162' or legs extend upward in a vertical direction perpendicular to the base bottom surface 170 at the respective first and second bottom outside corners 182, 182'. The first base sidewall 162 and second base sidewall 162' extend in a vertical direction relative to the inclined base major drain surface 174 at the first and second bottom inside corners 178, 178'. The first base sidewall 162 terminates at a first upper outside corner 186 spaced above the first bottom outside corner 182 in a common outer vertical plane with same. The first base sidewall 162 has a first sidewall outer surface 190 defined between the first upper outside corner 186 and first bottom outside corner 182 and extending in the common outer vertical plane defined therebetween. The first base sidewall 162 terminates at a first upper inside corner 192 spaced above the first bottom inside corner 178 in a common inner vertical plane with same. The first base sidewall 162 has a first sidewall inner surface 190' defined between the first upper inside corner 192 and first bottom inside corner 178 and extending in the common inner vertical plane defined therebetween.

As shown in FIG. 3, the base 158 includes a first base seat 204 atop first base sidewall 162 at an upper terminus of same. First base seat 204 may have a female configuration. First base seat 204 may include an elongated first seating surface 194 at top of the first base sidewall 162. First seating surface 194 intersects the first sidewall outer surface 190 at first upper outside corner 186. First base seat 204 may include an elongated notch or first seating channel 198 adjoining the first seating surface 194. First base seat 204 may include an elongated first prime seating surface 194' adjoining the first seating channel 198 opposite the first seating surface 194. The first seating channel 198 thus divides the first prime seating surface 194' from first seating surface 194. The first prime seating surface 194' intersects a second prime sidewall inner surface 190" extending parallel to first sidewall outer surface 190, and disposed in spaced, opposed relationship to the first sidewall outer surface 190, at a first prime upper inside corner 192'. The second prime sidewall inner surface 190" extends downward from the first prime upper inside corner 192' to a second prime upper inside corner 192". The second prime sidewall inner surface 190" terminates at the second prime upper inside corner 192". A first seat minor return 199 includes a downward facing surface disposed in opposition to the elongated first seating channel 198 and first prime seating surface 194'. The first seat minor return 199 extends from the second prime upper inside corner 192" where it intersects the second prime sidewall inner surface 190", to the first upper inside corner 192 where it intersects the first sidewall inner surface 190'. The first seating surface 194 and first prime seating surface 194' are thus located above the first seat minor return 199 at a first seat height.

As shown in FIG. 3, base 158 includes a second base seat 204' atop second base sidewall 162' at a terminus of same. Second base seat 204' may have a female configuration. The second base sidewall 162' terminates at a first upper outside corner 286 spaced above the second bottom outside corner 182' in a common outer vertical plane with same. The second base sidewall 162' has a second sidewall outer surface 290 defined between the second upper outside corner 286 and second bottom outside corner 182' and extending in the common outer vertical plane defined therebetween. The second base sidewall 162' terminates at a second upper inside corner 292 spaced above the second bottom inside corner 178' in a common inner vertical plane with same. The second base sidewall 162' has a second sidewall inner surface 290' defined between the second upper inside corner 292 and second bottom inside corner 178' and extending in the common inner vertical plane defined therebetween.

As shown in FIG. 3, the base 158 includes an elongated second seating surface 294 intersecting the second sidewall outer surface 290 at second upper outside corner 286. Base 158 includes an elongated second seating channel 298 adjoining the second seating surface 294. Base 158 includes an elongated second prime seating surface 294' adjoining the second seating channel 298 opposite the second seating surface 294. The second seating channel 298 thus divides the second prime seating surface 294' from second seating surface 294. The second prime seating surface 294' intersects a second prime sidewall inner surface 290" extending parallel to second sidewall outer surface 290, and disposed in spaced, opposed relationship to the second sidewall outer surface 290, at a second prime upper inside corner 292". The second prime sidewall inner surface 290" extends downward from the first prime upper inside corner 292' to second prime upper inside corner 292". The second prime sidewall inner surface 290" terminates at the second prime upper inside corner 292". A second seat minor return 299 includes a downward facing surface disposed in opposition to the elongated second seating channel 298 and second prime seating surface 294'. The second seat minor return 299 extends from the second prime upper inside corner 292" where it intersects the second prime sidewall inner surface 290", to the second upper inside corner 292 where it intersects the second sidewall inner surface 290'. The second seating surface 294 and second prime seating surface 294' are thus located above the second seat minor return 299, at a second seat height.

As shown in FIG. 3, the first base sidewall 162 may terminate at a first base seat 204 spaced above and disposed in opposition to the base bottom surface 174. The first base seat 204 may have a female seat configuration for mating engagement with the first crown seat 304 to support crown 154 upon base 158. The second base sidewall 162' may terminate at a second base seat 204' spaced above and disposed in opposition to the base bottom surface 170. The second base seat 204' may have a female seat configuration for mating engagement with the second crown seat 304' to support crown 154 upon base 158. In other embodiments (not shown) where the first and second crown seats 304, 304' may have a female configuration, the first and second base seats 204, 204' may have a male seat configuration for mating engagement with the first and second crown seats 304, 304'. In other embodiments (not shown), one of the first and second base seats 204, 204' may have a male seat configuration and the other of the first and second base seats 204, 204' may have a female seat configuration. It will be understood that the first and second base seats 204, 204' may be configured to be received in mating seated connection relationships with corresponding of the first and second crown seats 304, 304'. It will be understood further that the first and second base seats 204, 204' may be configured to be received in mating seated connection relationships with corresponding of the first and second crown seats 304, 304', alternatively in either a first configuration for in-swing door operation (shown in FIGS. 1-4 and 11-14) with the crown first upper side 274 located nearest the threshold first side 128 and supported on the first base seat 204 of the first base sidewall 162 and with the crown second upper side 275 located nearest the threshold second side 128' and supported on the second base seat 204' of the second base sidewall 162', or in a second configuration reversed from the first configuration and for out-swing door operation as shown in FIGS. 5-8 with the crown second upper side 275 nearest the threshold first side 128 and supported on the first base seat 204 of the first base sidewall 162 and crown first upper side 274 located nearest the threshold second side 128' and supported on the second base seat 204' of the second base sidewall 162'. The crown 154 thus may be installed upon base 158 by mating engagement of the first and second crown seats 304, 304' with the mating first and second base seats 204, 204' in interchangeable, reversed first and second positions, aligned for door in-swing operation in the first position and aligned for door out-swing operation in the second position.

As shown in FIG. 3, crown 154 may have a crown width perpendicular to the crown longitudinal axis 324 and extending between a pair of spaced, opposed crown sidewalls 360 each extending parallel to the crown longitudinal axis 324. The pair of crown sidewalls 360 may include first crown sidewall 362 and second crown sidewall 362'.

Crown 154 includes a crown topmost wall 366 intersecting the first crown sidewall 362 and second crown sidewall 362', and extending therebetween in a lateral direction perpendicular to crown longitudinal axis 324. Crown topmost wall 366 includes a crown upper surface 370 facing upward, spaced above base 158 and extending perpendicular to crown longitudinal axis 324 for mating engagement with door element bottom 142 of door element 104 in the closed position. Crown bottom surface 371 is disposed in opposition to crown upper surface group 370 and intersects and extends between first crown sidewall 362 at first upper inside corner 373 and second crown sidewall 362' at second upper inside corner 372'. Crown upper surface group 370 of the crown topmost wall 366 includes a crown minor upper surface 374, crown major upper surface 375, and crown gutter 377 disposed between crown minor upper surface 374 and crown major upper surface 375. Crown upper surface group 370 is disposed in opposition and spaced above crown bottom surface 371. Crown minor upper surface 374 extends between and intersects the first crown sidewall 362 at first upper outside corner 378 and intersects crown gutter 377 at gutter first edge 383. Crown major upper surface 375 extends between and intersects the second crown sidewall 362' at second upper outside corner 378' and intersects crown gutter 377 at gutter second edge 383'. First upper outside corner 378 is located at a crown minor height, which is below second upper outside corner 378' located at crown major height. The first and second upper outside corners 378, 378' are spaced above and outside respective first and second upper inside corners 373, 373' disposed in opposition to same. First upper inside corner 373 is located at a crown minor inside height, which is below second upper inside corner 373' located at crown major inside height.

Figure 4:
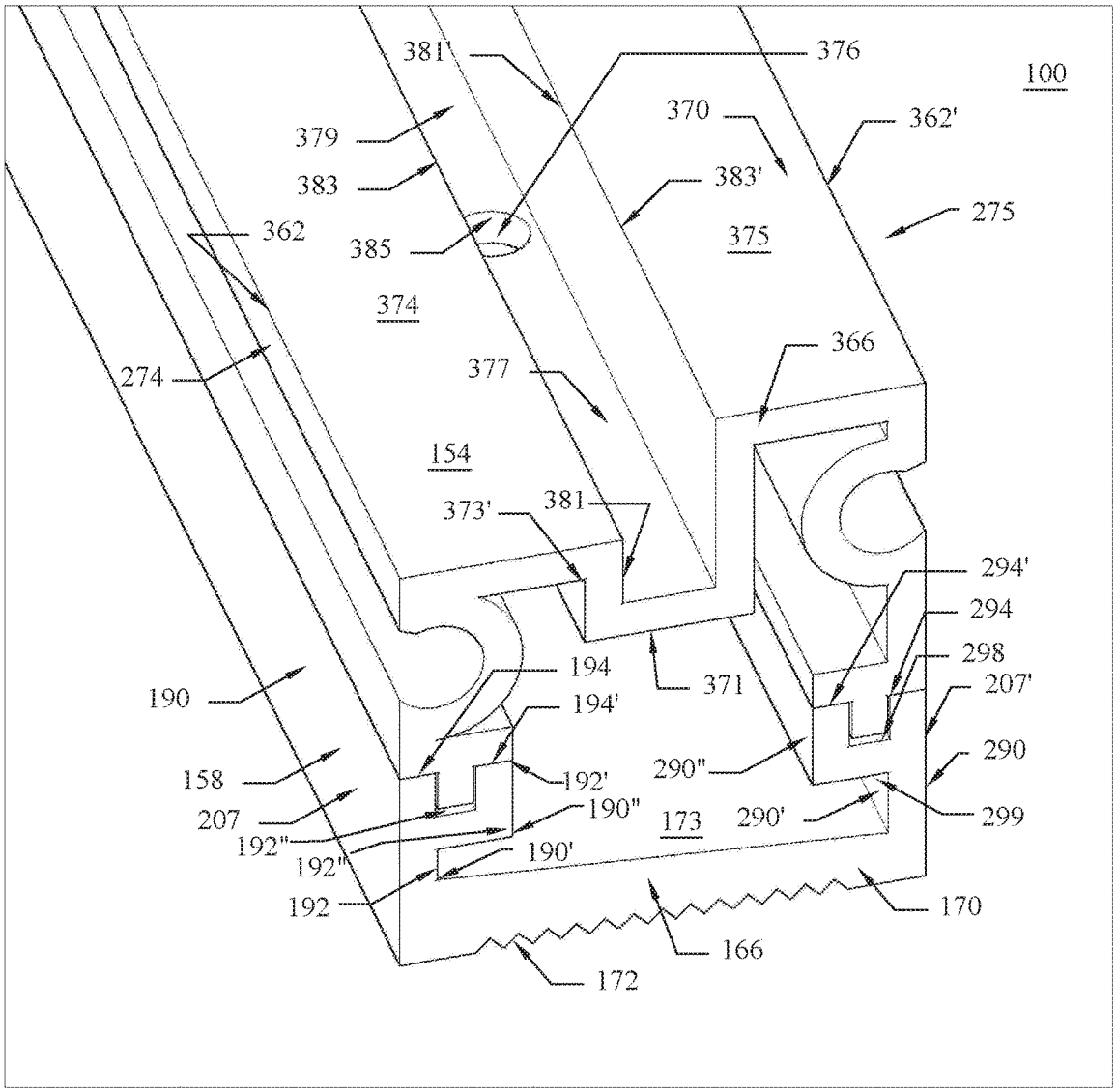
FIG. 4 is a simplified partial perspective isolation view, similar to FIG. 3, showing the threshold of door system 100 from an elevated end perspective with the crown in the first position and with door element configured for in-swing operation.

As shown in FIG. 3, elongated crown gutter 377 is adjacent and adjoins crown minor upper surface 374 at gutter first edge 383. Crown gutter 377 extends from gutter first edge 383 to gutter second edge 383' in the lateral direction perpendicular to crown longitudinal axis 324. Crown gutter 377 is adjacent and adjoins crown major upper surface 375 at the gutter second edge 383'. Crown gutter 377 includes an elongated gutter surface 379 located at a respective gutter height and intermediate a pair of opposed first and second gutter sidewalls 381, 381'. Crown gutter 377 thus extends from crown minor height of the crown minor upper surface 374 at gutter first edge 283, downward at first gutter sidewall 381 into intersection with and across gutter surface 379 at gutter height, and extends back up second gutter sidewall 381' to gutter second edge 383', where crown gutter 377 terminates at crown major height of the adjoining crown major upper surface 375. Referring to FIG. 4, crown gutter 377 includes a plurality of spaced apertures or gutter drain holes 376 defined in the gutter surface 379 and spaced along crown longitudinal axis 324 for passing precipitation or water collected in crown gutter 377 downward through the gutter drain holes 376 into the base drain channel 173 having inclined base major drain surface 174 and configured to direct and pass liquid out through base drain holes 187 to the exterior side 129' of base 158 and to the exterior outside of the building. It will be understood that base 158 may be installed to always direct and pass liquid out through base drain holes 187 to the exterior of base 158 and outside of the building, independent of the orientation or position of crown 154 supported on base 158 by the aligned, mating first and second seat connections 207, 207' therebetween. It will be understood that base 158 may be installed to always direct and pass liquid out through base drain holes 187 to the exterior side 129' of base 158 and threshold assembly 120 and to the exterior or outside of the building, independent of threshold assembly 120 being installed in the first configuration for door in-swing operation (shown in FIGS. 1-4 and 11-14) or in the second configuration for door out-swing operation (shown in FIGS. 5-10 and 15-16).

As shown in FIG. 3, the first crown sidewall 362 or leg extends downward in a vertical direction perpendicular to the crown minor upper surface 374 at crown first upper outside corner 378. The second crown sidewall 362' or leg extends downward in a vertical direction perpendicular to the crown major upper surface 375 at the crown second upper outside corner 378'. The first crown sidewall 362 terminates at a first crown seat 304 spaced below and disposed in opposition to the crown minor upper surface 374. The first crown sidewall 362 may include a first wing wall receiver 308 disposed between the first crown seat 304 and crown minor upper surface 374. The first crown seat 304 may have a male seat configuration. The second crown sidewall 362' terminates at a second crown seat 304' spaced below and disposed in opposition to the crown major upper surface 375. The second crown sidewall 362' may include a second wing wall receiver 308' disposed between the second crown seat 304' and crown major upper surface 375. The second crown seat 304' may have a male seat configuration. In other embodiments (not shown), the first and second crown seats 304, 304' may have a female seat configuration. In other embodiments (not shown), one of the first and second crown seats 304, 304' may have a male seat configuration and the other of the first and second crown seats 304, 304' may have a female seat configuration. It will be understood that the first and second crown seats 304, 304' may be configured to be received in mating seated connection relationships with corresponding of the first and second base seats 204, 204' to form first and second seat connections 207, 207'. It will be understood further that the first and second crown seats 304, 304' may be configured to be received in mating seated connection relationships with corresponding of the first and second base seats 204, 204', alternatively in either a first configuration for in-swing door operation (shown in FIGS. 1-4 and 11-14) with the crown minor side 385 located nearest the threshold first side 128 and supported on the first base seat 204 of the first base sidewall 162 and with crown major side 385' located nearest the threshold second side 128' and supported on the second base seat 204' of the second base sidewall 162', or in a second configuration (the second configuration being reversed from, and a mirror image of, the first configuration) for out-swing door operation (as shown in FIGS. 5-10 and 15-16) with the crown major side 385' nearest the threshold first side 128 and supported on the first base seat 204 of the first base sidewall 162 and crown minor side 385 located nearest the threshold second side 128' and supported on the second base seat 204' of the second base sidewall 162'. The crown 154 thus may be installed upon base 158 by mating engagement of the first and second crown seats 304, 304' with the mating first and second base seats 204, 204' forming first and second seat connections 207, 207' and in interchangeable, reversed or mirror image first and second positions, aligned for door in-swing operation in the first position and aligned for door out-swing operation in the second position.

The crown 154 may provide minor stop surface 399' and major stop surface 399" for mating stop engagement with first and second steps 144', 144" of the bottom 142 of door element 104 to form a seal with the weather-stripping thereof and limit travel of the door element 104 relative to threshold assembly 120. The stop surfaces 399 may include minor stop surface 399', which may be defined by the first crown sidewall 362 of crown 154 immediately below minor upper surface 374, and major stop surface 399", which may be defined by the second gutter wall 381' immediately below major upper surface 375 of crown 154 in the first configuration for door in-swing operation and in the second configuration for door out-swing configuration. In the first configuration for door in-swing configuration (shown in FIGS. 1-4 and 11-14), crown 154 may be oriented such that first crown sidewall 362 located immediately below crown minor upper surface 374 forms the minor stop surface 399' in mating stop engagement with first step 144' of bottom 142 of door element 104 and simultaneously the second gutter sidewall 381' located immediately below crown major upper surface 375 forms a major stop surface 399" in mating stop engagement with second step 144" of bottom 142 of door element 104 to prevent in-swing travel of door element 104 in the closed position. In the second configuration for door out-swing configuration (shown in FIGS. 5-10 and 15-16), crown 154 may be oriented such that first crown sidewall 362 located below crown minor upper surface 374 forms a minor stop surface 399' in mating stop engagement with first step 144' of bottom 142 of door element 104 and simultaneously the second gutter sidewall 381' located below crown major upper surface 375 forms a major stop surface 399" in mating stop engagement with second step 144" of bottom 142 of door element 104 to prevent out-swing travel of door element 104 in the closed position.

Figures 11, 12:
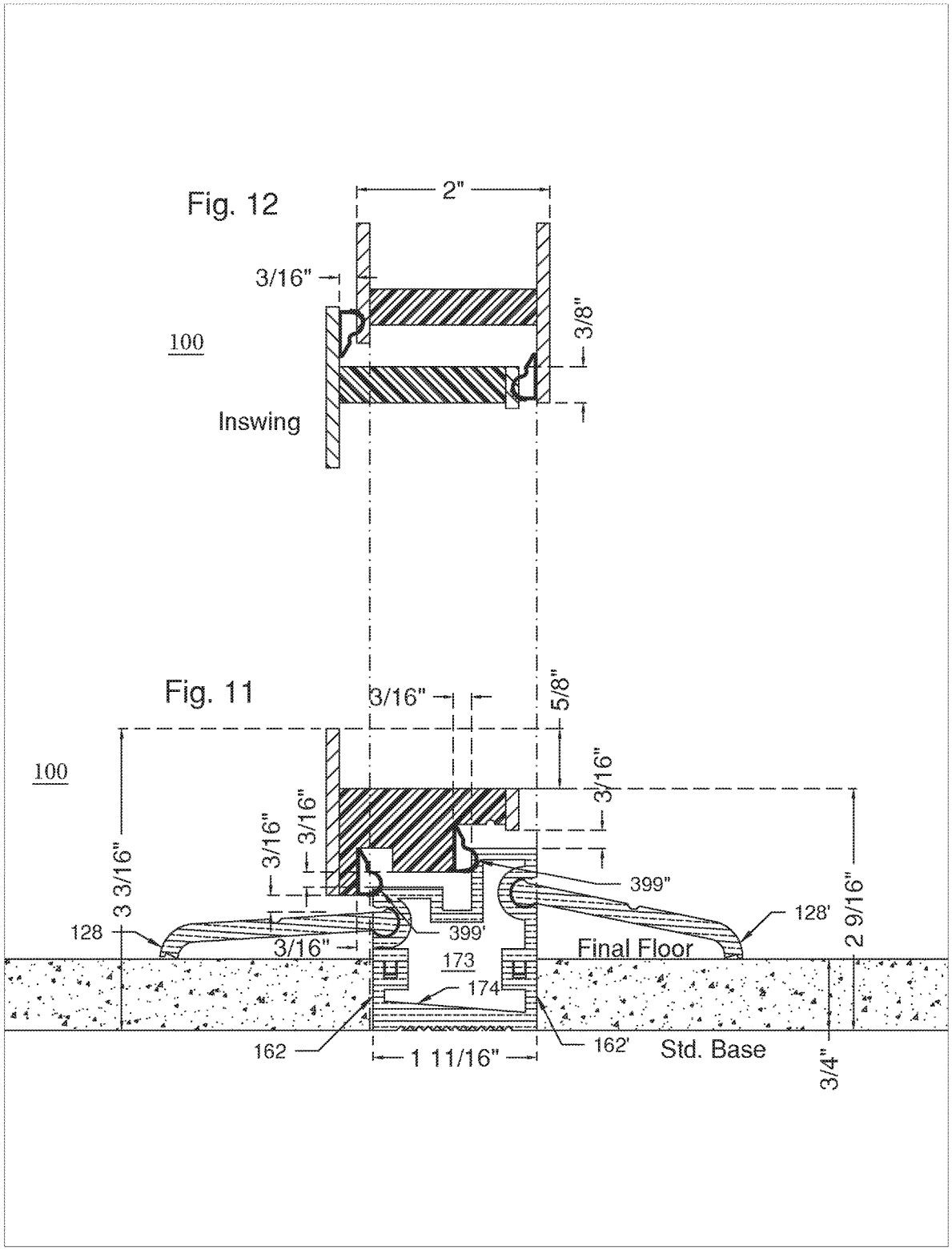
FIG. 11 is a simplified partial cross-sectional view taken generally along 11-11 in FIG. 1, showing detail of door system 100 with the door element in the in-swing configuration and pivoted to the closed position.
FIG. 12 is a simplified partial cross-sectional view taken showing detail of door system 100 shown in FIG. 1, with the door element in the in-swing configuration and pivoted to the closed position.

As best shown in FIG. 11, threshold assembly 120 may include a pair of first and second wing walls 410, 410' each extending outward in the lateral direction perpendicular to the longitudinal axis 124 from respective of the first and second crown sidewalls 362, 362' of crown 154. Each of the first and second wing walls 410, 410' may be configured to cover a gap between crown 154, base 158, or both, and respective of the first floor 111 and second floor 111' adjacent the same and provide first and second wing footing surfaces 416, 416' to support the feet of individuals passing through door system 100 and stepping on threshold assembly 120 adjacent first floor 111 or second floor 111'. First wing wall 410 may include an elongated first wing free edge 415 extending parallel to longitudinal axis 124 and defining the elongated first side 128 of threshold assembly 120. First wing wall 410 may include an elongated first pivot joint male element 420 spaced from first wing free edge 415 and disposed in opposition to same. First wing wall 410 may have a wing wall top surface 430 that defines the first wing footing surface 416 and extends from first wing free edge 415 to first pivot joint male element 420. Wing wall top surface 430 may include one or more footing grip elements 435 defined therein. First wing wall 410 may have a wing wall lower surface 440 opposite top surface 430. First pivot joint male element 420 may include an exterior surface 445 having a rounded profile in the lateral direction perpendicular to longitudinal axis 124. First pivot joint male element 420 may be configured to be received in captured mating pivotable engagement with first wing wall receiver 308, which may be female, for pivoting movement of the first wing wall 410 relative to first wing wall receiver 308 in a vertical plane to position the first wing free edge 415 in a static position resting upon first floor 111. First wing wall 410 may be supported by engagement of the first pivot joint male element 420 with female first wing wall receiver 308 and by engagement of the first wing free edge 415 with first floor surface 111 at elongated first side 128 of threshold assembly 120. In an embodiment, at least one of the first pivot joint male element 420 and female first wing wall receiver 308 may be configured to provide clearance for removal of the first wing wall 410 from crown 154 by pivoting the first pivot joint male element 420 relative to the female first wing wall receiver 308 to align same in a clearing relationship that permits the first pivot joint male element 420 to be removed from captured relationship with the female first wing wall receiver 308, such as where the first wing wall 410 is not needed to cover a gap or height differential between the crown 154 and first floor 111.

Second wing wall 410' may include an elongated second wing free edge 415' extending parallel to longitudinal axis 124 and defining the elongated second side 128' of threshold assembly 120. Second wing wall 410' may include an elongated second pivot joint male element 420' spaced from second wing free edge 415' and disposed in opposition to same. Second wing wall 410' may have a wing wall top surface 430 that defines the second wing footing surface 416' and extends from second wing free edge 415' to second pivot joint male element 420'. Wing wall top surface 430 may include one or more footing grip elements 435 defined therein. Second wing wall 410' may have a wing wall lower surface 440 opposite wing wall top surface 430. Second pivot joint male element 420' may include an exterior surface 445 having a rounded profile in the lateral direction perpendicular to longitudinal axis 124. Second pivot joint male element 420' may be configured to be received in captured mating pivotable engagement with female second wing wall receiver 308' for pivoting movement of the second wing wall 410' relative to second wing wall receiver 308' in a vertical plane to position the second wing free edge 415' in a static position resting upon second floor 111'. Second wing wall 410' may be supported by engagement of the second pivot joint male element 420' with female second wing wall receiver 308' and by engagement of the second wing free edge 415' with second floor surface 111' at elongated second side 128' of threshold assembly 120. In an embodiment, at least one of the second pivot joint male element 420' and female second wing wall receiver 308' may be configured to provide clearance for removal of the second wing wall 410' from crown 154 by pivoting the second pivot joint male element 420' relative to the female second wing wall receiver 308' to align same in a clearing relationship that permits the second pivot joint male element 420' to be removed from captured relationship with the female second wing wall receiver 308', such as where the second wing wall 410' is not needed to cover a gap or height differential between the crown 154 and second floor 111'.

FIG. 2 is a simplified partial perspective view of a portion of door system 100, shown generally in FIG. 1, including threshold assembly 120 with the crown 154 in the first position and with door element 104 configured for in-swing operation.

FIG. 3 is a simplified partial perspective isolation view of the threshold of door system 100, shown generally in FIG. 1, from an end perspective, with the crown 154 in the first position and with door element 104 configured for in-swing operation.

FIG. 4 is a simplified partial perspective isolation view, similar to FIG. 3, showing the threshold of door system 100 from an elevated end perspective with the crown 154 in the first position and with door element 104 configured for in-swing operation.

Figure 5:
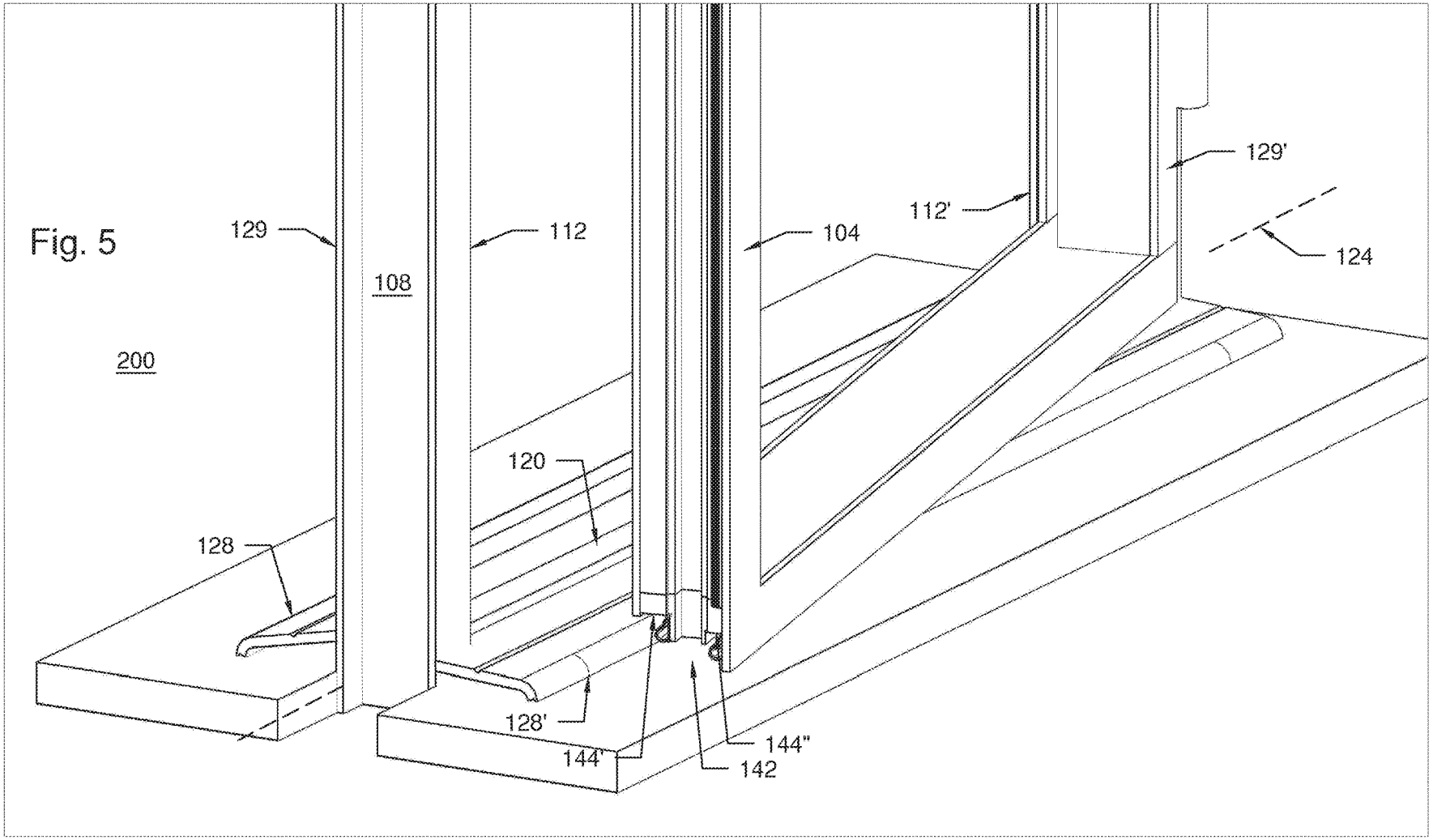
FIG. 5 is a simplified partial perspective view, similar to FIG. 1, showing a door system 200 in an out-swing configuration, in an embodiment.

FIG. 5 is a simplified partial perspective view, similar to FIG. 1, showing a door system 200 in an out-swing configuration, in an embodiment. Door system 200 may be identical to door system 100 (shown in FIGS. 1-4 and 11-14) except for differences described herein or illustrated in FIGS. 5-10 and 15-16. In FIGS. 5-10 and 15-16, crown 154 is shown in the second position for engagement with the door element 104 configured for out-swing operation, and wherein the crown 154 in the illustrated second position (shown in FIGS. 5-10 and 15-16) is reversed in relation to, or a mirror image of, the first position shown in FIGS. 1-4 and 11-14. In the second position of crown 154, the second crown sidewall 262' is adjacent the first floor 111 in the interior of the building, such that both second stop surface 399' and first stop surface 399 face the exterior of the building, for stop mating engagement with the mating steps at bottom 142 of door element 104 in the out-swing configuration, in the closed position.

Figure 6:
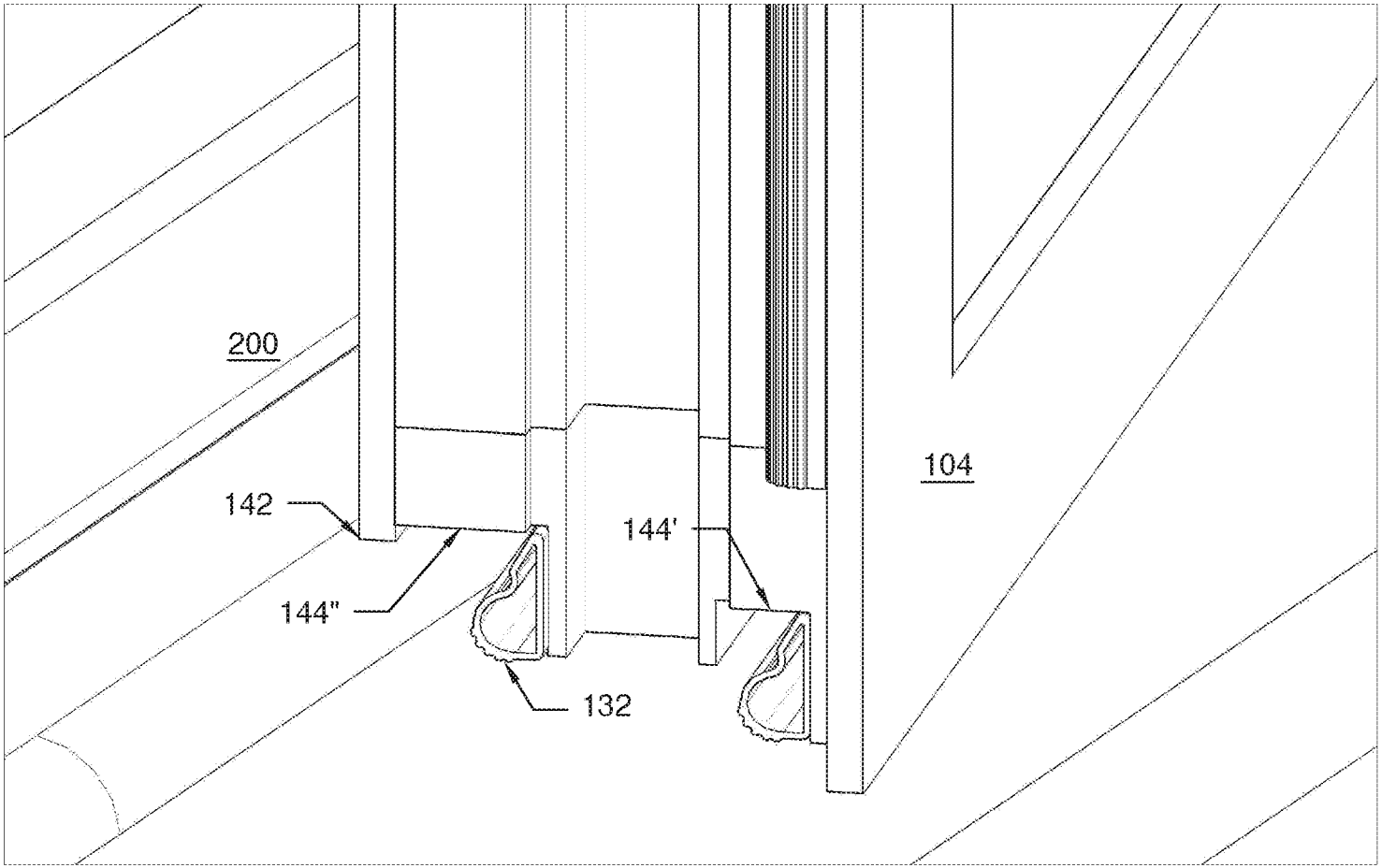
FIG. 6 is a simplified partial perspective view of a portion of door system 200, shown generally in FIG. 5.

FIG. 6 is a simplified partial perspective view of a portion of door system 200, shown generally in FIG. 5. Threshold assembly 120 includes crown 154 shown in the second position with the second crown sidewall 262' adjacent the first floor 111 and supported by the first base sidewall 162 at a respective mating seat connection therebetween, and the first crown sidewall 262 adjacent the second floor 111' and supported by the second base sidewall 262 at a respective mating seat connection.

Figure 7:
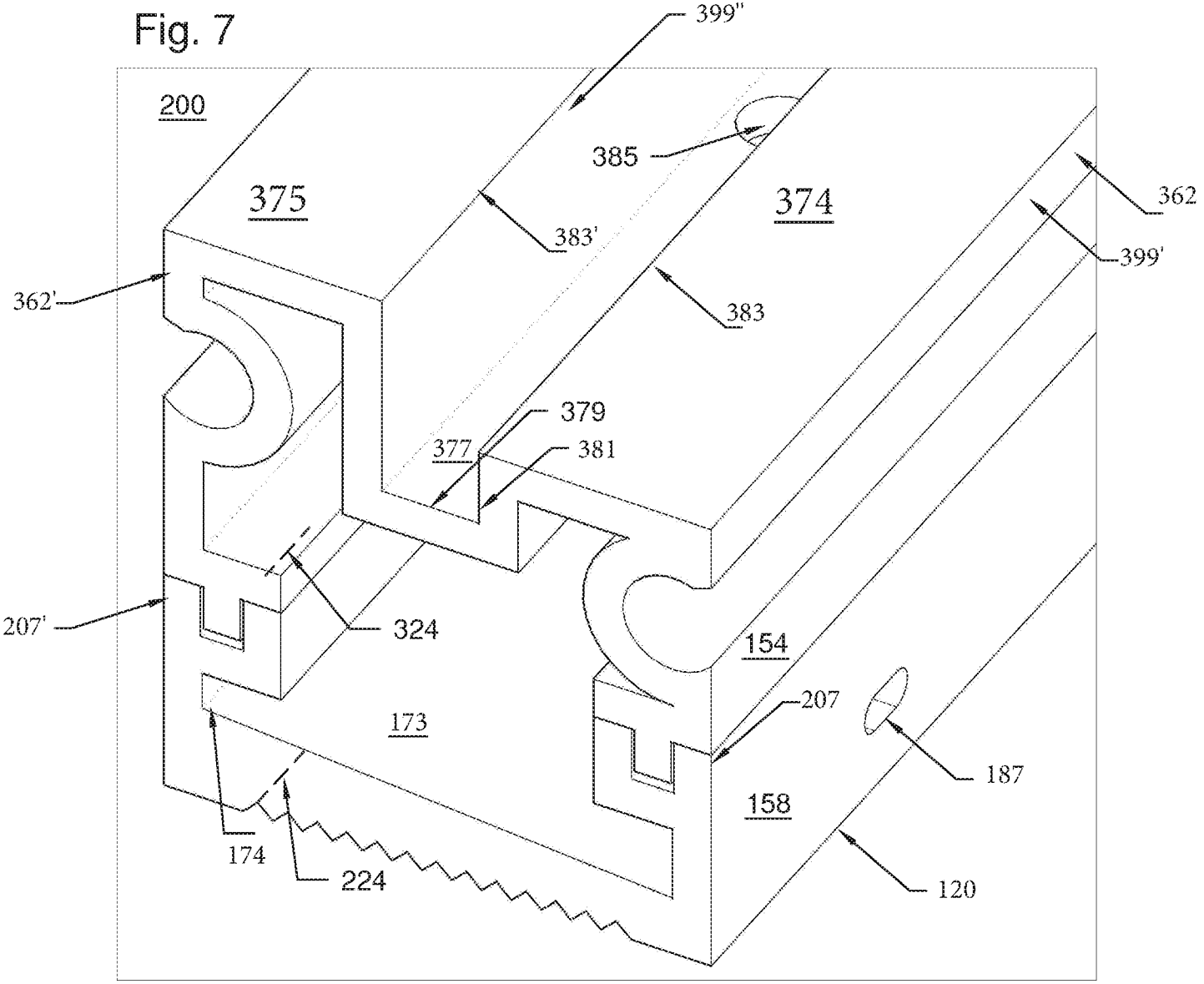
FIG. 7 is a simplified partial perspective isolation view of the threshold of door system 200, shown generally in FIG. 5, from an end perspective.
Figure 8:
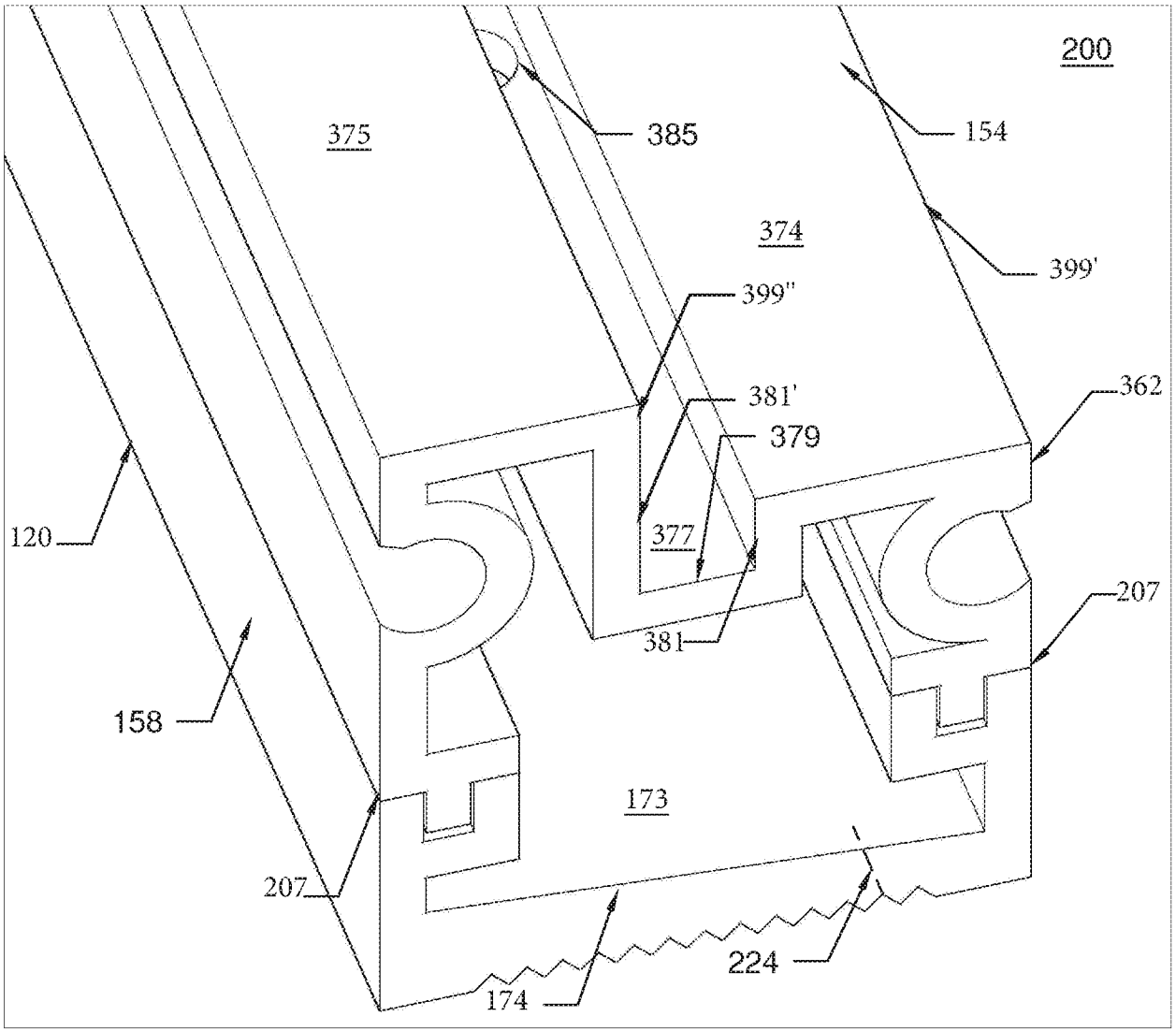
FIG. 8 is a simplified partial perspective isolation view, similar to FIG. 3, showing the threshold of door system 200 from an elevated end perspective with the crown in the second position and with door element configured for out-swing operation.

FIG. 7 is a simplified partial perspective isolation view of the threshold of door system 200, shown generally in FIG. 5, from an end perspective. Crown 154 is shown in the second position described elsewhere herein. FIG. 8 is a simplified partial perspective isolation view, similar to FIG. 7, showing the threshold assembly 120 of door system 200 from an elevated end perspective. Crown 154 is shown in the second position described elsewhere herein.

Figure 9:
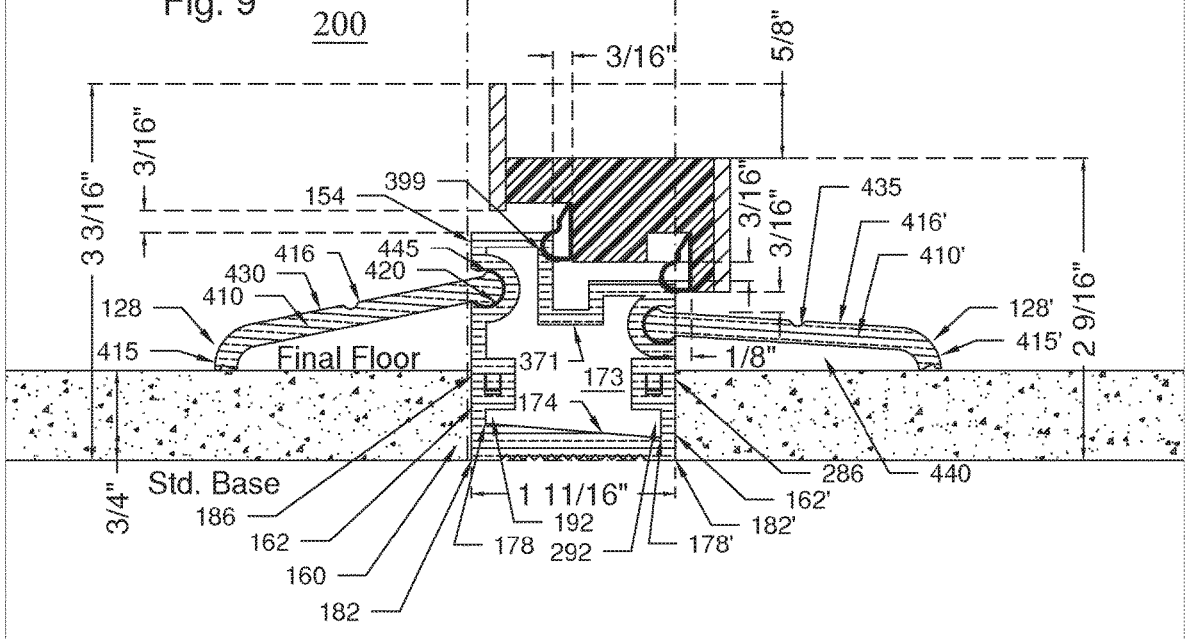
FIG. 9 is a simplified partial cross-sectional view taken generally along 9-9 in FIG. 5, showing detail of door system 200 with the door element in the out-swing configuration and pivoted to the closed position.

FIG. 9 is a simplified partial cross-sectional view taken generally along 9-9 in FIG. 5, showing detail of door system 200 with the door element 104 in the out-swing configuration and pivoted to the closed position.

Figure 10:
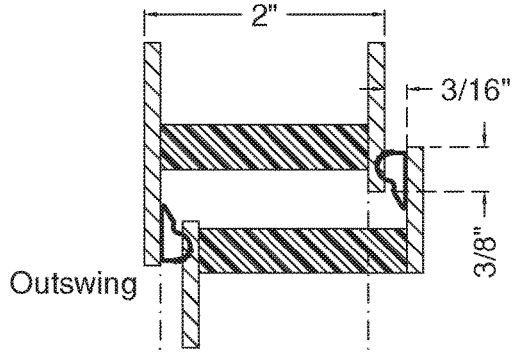
FIG. 10 is a simplified partial cross-sectional view taken showing detail of door system 200 shown in FIG. 5, with the door element in the out-swing configuration and pivoted to the closed position.

FIG. 10 is a simplified partial cross-sectional view taken showing detail of door system 200 shown in FIG. 5, with the door element 104 in the out-swing configuration and pivoted to the closed position.

FIG. 11 is a simplified partial cross-sectional view taken generally along 11-11 in FIG. 1, showing detail of door system 100 with the door element 104 in the in-swing configuration and pivoted to the closed position.

FIG. 12 is a simplified partial cross-sectional view taken showing detail of door system 100 shown in FIG. 1, with the door element 104 in the in-swing configuration and pivoted to the closed position.

Figures 13, 14, 15, 16:
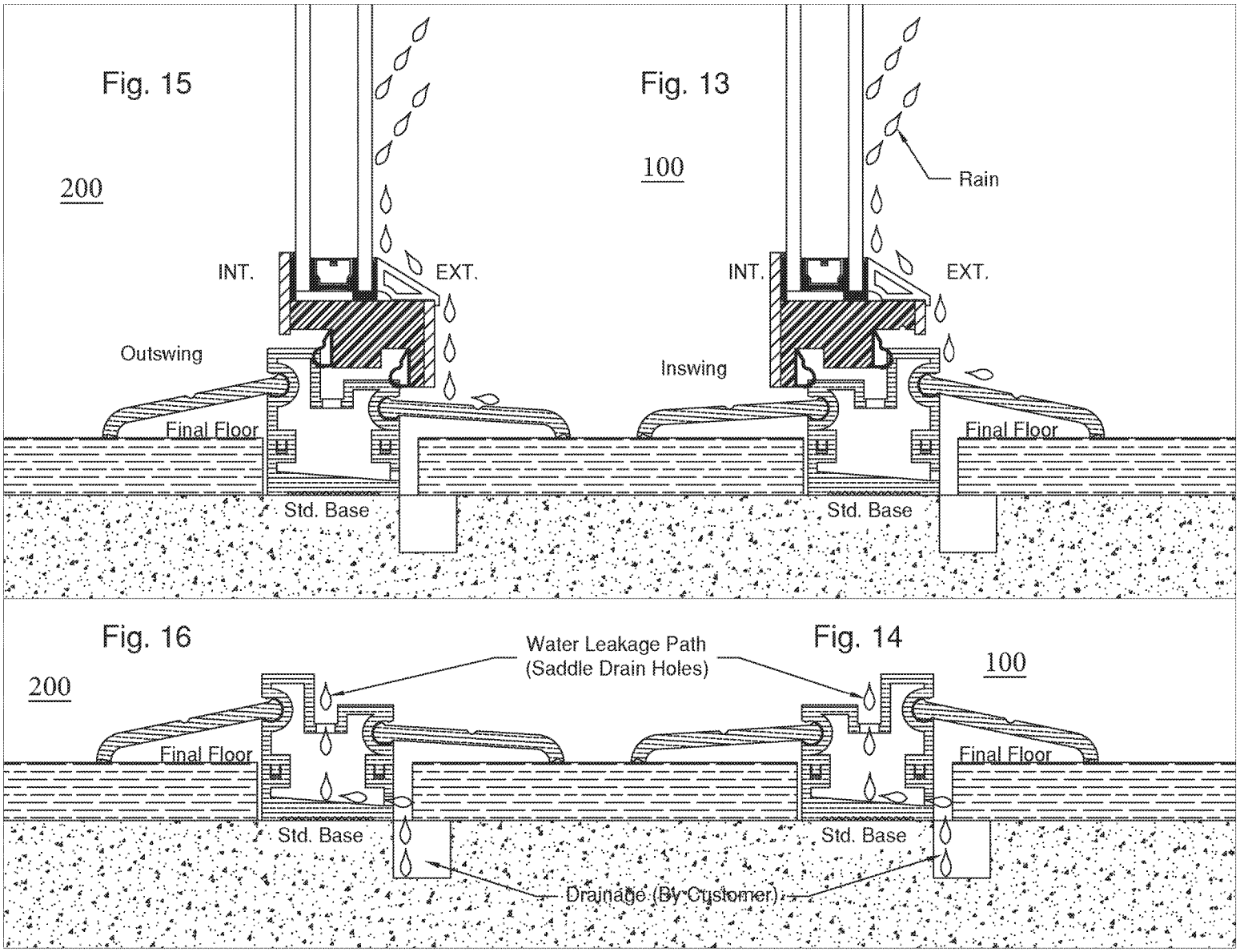
FIG. 13 is a simplified partial cross-sectional view showing detail of door system 100 of FIG. 1, with the door element in the in-swing configuration and pivoted to closed position.
FIG. 14 is a simplified partial cross-sectional view similar to FIG. 13, showing detail of door system 100 with the door element omitted for clarity.
FIG. 15 is a simplified partial cross-sectional view showing detail of door system 200 of FIG. 5, with the door element in the out-swing configuration and pivoted to closed position.
FIG. 16 is a simplified partial cross-sectional view similar to FIG. 15, showing detail of door system 200, with the door element omitted for clarity.

FIG. 13 is a simplified partial cross-sectional view showing detail of door system 100 of FIG. 1, with the door element 104 in the in-swing configuration and pivoted to closed position. A shedding flow path for the door system 100 with the door element 104 in the closed position and shedding precipitation to the exterior or outside of the building is shown.

FIG. 14 is a simplified partial cross-sectional view similar to FIG. 13, showing detail of door system 100 with the door element omitted for clarity. A draining flow path for the door system 100 collecting precipitation at the crown and directing the collected precipitation to flow from the crown downward into the base drain channel 173, and drain from the base 158 outward through base drain holes 187 to the exterior or outside of the building, is shown.

FIG. 15 is a simplified partial cross-sectional view showing detail of door system 200 of FIG. 5, with the door element 104 in the out-swing configuration and pivoted to closed position. A shedding flow path for the door system 100 with the door element 104 in the closed position and shedding precipitation to the exterior of the building is shown.

FIG. 16 is a simplified partial cross-sectional view similar to FIG. 15, showing detail of door system 200, with the door element omitted for clarity. A draining flow path for the door system 100 collecting precipitation at the crown and directing the collected precipitation to flow from the crown downward into the base drain channel 173, and drain outward from the base drain channel 173 through base drain holes 187, to the exterior or outside of the building, is shown.

Apparatus, methods and systems according to embodiments of the disclosure are described. Although specific embodiments are illustrated and described herein, it will be appreciated by those of ordinary skill in the art that any arrangement which is calculated to achieve the same purposes can be substituted for the specific embodiments shown. This application is intended to cover any adaptations or variations of the embodiments and disclosure. For example, although described in terminology and terms common to the field of art, exemplary embodiments, systems, methods and apparatus described herein, one of ordinary skill in the art will appreciate that implementations can be made for other fields of art, systems, apparatus or methods that provide the required functions. The invention should therefore not be limited by the above described embodiment, method, and examples, but by all embodiments and methods within the scope and spirit of the invention.

In particular, one of ordinary skill in the art will readily appreciate that the names of the methods and apparatus are not intended to limit embodiments or the disclosure. Furthermore, additional methods, steps, and apparatus can be added to the components, functions can be rearranged among the components, and new components to correspond to future enhancements and physical devices used in embodiments can be introduced without departing from the scope of embodiments and the disclosure. One of skill in the art will readily recognize that embodiments are applicable to future systems, future apparatus, future methods, and different materials.

All methods described herein can be performed in a suitable order unless otherwise indicated herein or otherwise clearly contradicted by context. The use of any and all examples, or exemplary language (e.g., "such as"), is intended merely to better illustrate the disclosure and does not pose a limitation on the scope of the disclosure unless otherwise claimed. No language in the specification should be construed as indicating any non-claimed element as essential to the practice of the disclosure as used herein.

Terminology used in the present disclosure is intended to include all environments and alternate technologies that provide the same functionality described herein.

What is claimed is:

1. A threshold assembly for a door system, said door system having an interior side proximate an interior space of a building, said door system having an exterior side opposite said interior side, said exterior side proximate an exterior of said building, said threshold assembly comprising:

a base comprising:

a base bottom wall, said base bottom wall comprising a major drain surface inclined from a second edge to a first edge thereof;

a base drain channel comprising said major drain surface, said major drain surface intersecting a first base sidewall at said first edge proximate the interior side, said major drain surface intersecting a second base sidewall at said second edge proximate the exterior side;

a base drain hole defined in said second base sidewall to convey water from said base drain channel out through said second base sidewall to the exterior side;

a first base seat on said first base sidewall above said base drain channel;

a second base seat on said second base sidewall above said base drain channel;

said first base seat configured for mating seated engagement with a first crown seat in a first seat connection;

said second base seat configured for mating seated engagement with a second crown seat in a second seat connection;

a crown supported by said base, said crown comprising:

said first crown seat on a first crown sidewall;

said second crown seat on a second crown sidewall;

a crown minor side above said first crown seat, said crown minor side supported by said first crown sidewall;

a crown major side above said second crown seat, said crown major side supported by said second crown sidewall;

a crown gutter intermediate said crown minor side and said crown major side;

a gutter drain hole defined in said crown gutter to convey water from said crown gutter downward into said base drain channel;

said crown selectively installable on said base in a first position for in-swing movement of a door element or a second position for out-swing movement of the door element, said crown position selectable independent of said base positioned to convey water from the base drain channel to the exterior side; and said door element comprising door bottom steps including a lower step adjacent an upper step, in a closed position said lower step engages in mating stop relationship with said crown minor side, said upper step engages in mating stop relationship with said crown major side.

2. The threshold assembly of claim 1, comprising:

in the closed position said lower step engages in mating stop relationship with a minor stop surface defined by said crown minor side, said upper step engages in mating stop relationship with a major stop surface defined by said crown major side.

3. The threshold assembly of claim 1, comprising:

one of a base first seat and a crown first seat comprising a male seat connection element, the other of said base first seat and said crown first seat comprising a female seat connection element configured for mating connection engagement with said male seat connection element.

4. The threshold assembly of claim 1, comprising:

one of a base first seat and a crown first seat comprising a male seat connection element, another of said base first seat and said crown first seat comprising a female seat connection element configured for mating connection engagement with said male seat connection element;

one of a base second seat and a crown second seat comprising a male seat connection element, another of said base second seat and said crown second seat comprising a female seat connection element configured for mating connection engagement with said male seat connection element.

5. A door system comprising the threshold assembly of claim 1.

6. The threshold assembly of claim 1, comprising:

said crown in said first position having said crown minor side proximate the interior side with said crown major side proximate the exterior side, at least one of said crown major side and said crown minor side engageable in mating stop relationship with the door element in the closed position, said door element supported for in-swing movement;

said crown in said first position having said crown major side proximate the interior side with said crown minor side proximate the exterior side, at least one of said crown major side and said crown minor side engageable in mating stop relationship with the door element in the closed position, said door element supported for out-swing movement.

7. The threshold assembly of claim 1, comprising:

a second wing wall extending from said second crown sidewall downward to a second free edge thereof resting on a second floor on said exterior side to shed water incumbent upon said door element in the closed position and said crown major side downward from said crown major side to said second free edge.

8. The threshold assembly of claim 1, comprising:

a first wing wall extending from said first crown sidewall downward to a first free edge thereof resting on a first floor on said interior side.

9. A threshold assembly for a door system, said door system having an interior side proximate an interior space of a building, said door system having an exterior side opposite said interior side, said exterior side proximate an exterior of said building, said threshold assembly comprising:

a base comprising:

a base bottom wall, said base bottom wall comprising a major drain surface inclined from a second edge to a first edge thereof;

a base drain channel comprising said major drain surface, said major drain surface intersecting a first base sidewall at said first edge proximate the interior side, said major drain surface intersecting a second base sidewall at said second edge proximate the exterior side;

a base drain hole defined in said second base sidewall to convey water from said base drain channel out through said second base sidewall to the exterior side;

a first base seat on said first base sidewall above said base drain channel;

a second base seat on said second base sidewall above said base drain channel;

said first base seat configured for mating seated engagement with a first crown seat in a first seat connection;

said second base seat configured for mating seated engagement with a second crown seat in a second seat connection;

a crown supported by said base, said crown comprising:

said first crown seat on a first crown sidewall;

said second crown seat on a second crown sidewall;

a crown minor side above said first crown seat, said crown minor side supported by said first crown sidewall;

a crown major side above said second crown seat, said crown major side supported by said second crown sidewall;

a crown gutter intermediate said crown minor side and said crown major side;

a gutter drain hole defined in said crown gutter to convey water from said crown gutter downward into said base drain channel;

said crown selectively installable on said base in a first position for in-swing movement of a door element or a second position for out-swing movement of the door element, said crown position selectable independent of said base positioned to convey water from the base drain channel to the exterior side;

weather-stripping intermediate a lower step of the door element to be engaged in mating stop relationship with said crown minor side; and weather-stripping intermediate an upper step of the door element to be engaged in mating stop relationship with said crown major side.

* * * * *